US011097332B2

(12) United States Patent
Takishima

(10) Patent No.: US 11,097,332 B2
(45) Date of Patent: Aug. 24, 2021

(54) METHOD FOR MANUFACTURING HOT PRESSED PRODUCT

(71) Applicant: Topre Corporation, Tokyo (JP)

(72) Inventor: Hiroaki Takishima, Sagamihara (JP)

(73) Assignee: TOPRE CORPORATION, Tokyo (JP)

( * ) Notice: Subject to any disclaimer, the term of this patent is extended or adjusted under 35 U.S.C. 154(b) by 373 days.

(21) Appl. No.: 16/115,161

(22) Filed: Aug. 28, 2018

(65) Prior Publication Data

US 2019/0091752 A1 Mar. 28, 2019

(30) Foreign Application Priority Data

Sep. 25, 2017 (JP) ..... JP2017-183596

(51) Int. Cl.

| | |
|---|---|
| ***B21D 28/34*** | (2006.01) |
| ***B21D 35/00*** | (2006.01) |
| ***B21D 37/10*** | (2006.01) |
| ***B21D 28/26*** | (2006.01) |
| ***B21D 22/20*** | (2006.01) |
| ***B21D 19/08*** | (2006.01) |

(52) U.S. Cl.

CPC ..... *B21D 28/343* (2013.01); *B21D 19/088* (2013.01); *B21D 22/208* (2013.01); *B21D 28/26* (2013.01); *B21D 35/001* (2013.01); *B21D 37/10* (2013.01)

(58) Field of Classification Search

CPC .... B21D 28/24; B21D 28/243; B21D 28/265; B21D 28/34; B21D 28/343; B21D 35/001; B21D 19/088; B21D 28/26; B26F 1/14

See application file for complete search history.

(56) References Cited

U.S. PATENT DOCUMENTS 6,293,134 B1 9/2001 Johnson

FOREIGN PATENT DOCUMENTS

| | | | | |
|---|---|---|---|---|
| DE | 29803483 U1 * | 4/1998 | ..... | E05B 17/0004 |
| JP | S 63-164860 U | 10/1988 | | |
| JP | 2004-330208 A | 11/2004 | | |
| JP | 2006-110609 A | 4/2006 | | |
| JP | 2010-75933 A | 4/2010 | | |

(Continued)

OTHER PUBLICATIONS

Japanese Patent Application No. 2017-183596, Notice of Reasons for Refusal, dated Apr. 13, 2021, 3 pages.

*Primary Examiner* — Debra M Sullivan

(74) *Attorney, Agent, or Firm* — Kilpatrick Townsend & Stockton LLP

(57) ABSTRACT

A method for manufacturing a hot pressed product by heating a sheet material and quenching the sheet material while molding the sheet material includes a hole forming step of forming a pilot hole in the sheet material; a heating step of heating the sheet material in which the pilot hole is formed; and a molding step of forming a burred portion at the pilot hole by using a burring punch included in a die set while molding the sheet material in the die set. The pilot hole has an opening shape in which convex portions and concave portions are alternately arranged. A diameter of a circumscribed circle that is in contact with the convex portions is greater than a punch diameter of the burring punch. A diameter of an inscribed circle that is in contact with the concave portions is less than the punch diameter of the burring punch.

14 Claims, 9 Drawing Sheets

(56) References Cited

FOREIGN PATENT DOCUMENTS

| | | | | | |
|---|---|---|---|---|---|
| JP | 2010179347 | | | 8/2010 | |
| JP | 2014-4625 | A | | 1/2014 | |
| JP | 2017183596 | | | 10/2017 | |
| KR | 10-2013-0063779 | A | | 6/2013 | |
| WO | WO-2018222109 | A1 | * | 12/2018 | ..... A47B 96/06 |

* cited by examiner

METHOD FOR MANUFACTURING HOT PRESSED PRODUCT

CROSS-REFERENCE TO RELATED APPLICATIONS

The present application claims priority from Japanese Patent Application No. 2017-183596 filed Sep. 25, 2017, the contents of which are hereby incorporated by reference into this application.

BACKGROUND

1. Field of the Invention

The present invention relates to a method for manufacturing a hot pressed product.

2. Description of the Related Art

Hot pressing is a method of processing a sheet material, such as a steel sheet, by heating the sheet material and quenching the sheet material while press-molding the heated sheet material by using a die set. A positioning hole may be formed in the sheet material during hot pressing. The positioning hole is used as, for example, a positioning reference in a post-processing step or as an assembly reference when the resulting hot pressed product is installed as a vehicle component. An example of a post-processing step performed after hot pressing is a step of removing unnecessary portions from a hot-pressed part. To prevent delayed fracture, for example, a laser process is often performed in the removing step.

However, the sheet material expands when heated and thermally contracts when press-molded during hot pressing, and it is therefore difficult to ensure sufficient positional accuracy of the positioning hole. When the positional accuracy is not sufficient, in the case where the positioning hole is used as a positioning reference in a laser process, the laser processing accuracy is affected. As a result, there is a risk that the quality of the resulting hot pressed product will be degraded.

Accordingly, a molded part may be manufactured by forming holes other than positioning holes in a base material before hot pressing, press-molding the base material by hot pressing, and then welding plates having positioning holes to the base material so that the positioning holes match the holes in the base material (see Japanese Unexamined Patent Application Publication No. 2010-179347, which is hereinafter referred to as Patent Document 1).

Alternatively, the positional accuracy can be increased by performing a burring process on a pre-formed hole and using the burred portion as, for example, a positioning hole (see U.S. Pat. No. 6,293,134, which is hereinafter referred to as Patent Document 2). According to Patent Document 2, the burring process may be applied to a molding step that involves hot pressing.

According to the technology disclosed in Patent Document 1, the plates having the positioning holes need to be prepared in addition to the base material. In addition, the plates are welded to the base material by using a positioning jig as a reference after the base material is subjected to press-molding, and this is not desirable in terms of production efficiency.

When a burred portion is formed around a pilot hole by using a burring punch during hot pressing, it is more difficult to accurately position the burring punch with respect to the pilot hole than when the burred portion is formed during cold working because of thermal expansion or contraction of the sheet material. Therefore, when the technology disclosed in Patent Document 2 is applied to hot pressing, misalignment between the pilot hole and the burring punch easily occurs. As a result, there is a risk that cracks will be formed in a flange portion that constitutes the burred portion.

SUMMARY

Accordingly, an object of the present invention is to provide an advantageous method for manufacturing a high-quality hot pressed product.

According to an aspect of the present invention, a method for manufacturing a hot pressed product by heating a sheet material and quenching the sheet material while molding the sheet material includes a hole forming step of forming a pilot hole in the sheet material; a heating step of heating the sheet material in which the pilot hole is formed in the hole forming step; and a molding step of forming a burred portion at the pilot hole by using a burring punch included in a die set while molding the sheet material heated in the heating step in the die set. The pilot hole has an opening shape in which a plurality of convex portions and a plurality of concave portions are alternately arranged. A diameter of a circumscribed circle that is in contact with the convex portions is greater than a punch diameter of the burring punch. A diameter of an inscribed circle that is in contact with the concave portions is less than the punch diameter of the burring punch.

The present invention provides an advantageous method for manufacturing a high-quality hot pressed product.

DETAILED DESCRIPTION

Figure 1A:
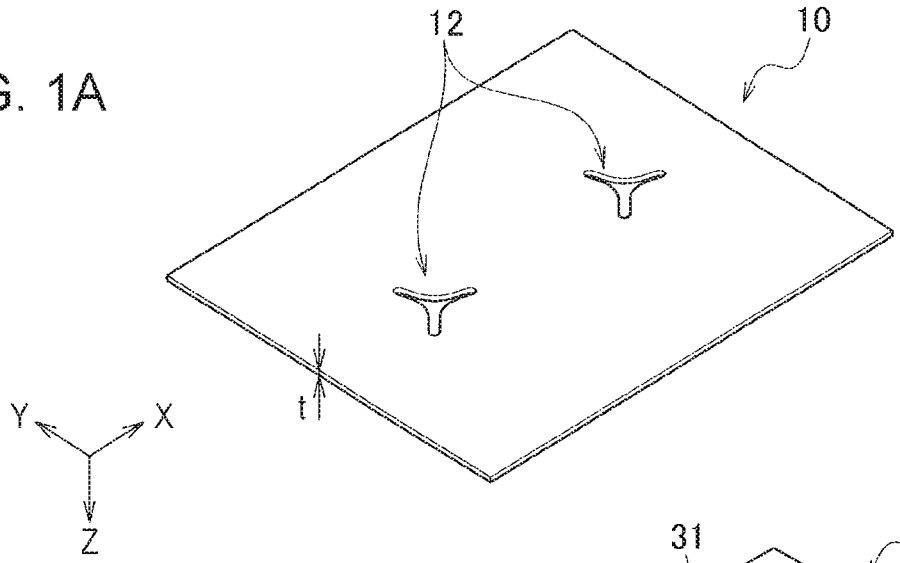
FIGS. 1A to 1C illustrate manufacturing steps according to an embodiment of the present invention.

An embodiment of the present invention will now be described in detail with reference to the drawings. The dimensions, materials, specific numerical values, etc., described below are merely examples, and do not limit the present invention unless specified otherwise. Components having substantially the same functions and structures are denoted by the same reference numerals, and description thereof is thus omitted. Components that are not directly relevant to the present invention are not illustrated. In each figure, the vertical direction, which is a pressing direction in which a die set is pressed, is defined as the Z direction, and an X-axis and a Y-axis perpendicular to the X-axis are defined along a plane perpendicular to the Z-axis.

Hot pressing is a method of processing a sheet material by heating the sheet material and quenching the sheet material while press-molding the heated sheet material by using a die set. A hot pressed product manufactured by a manufacturing method according to the present embodiment is a product manufactured by manufacturing steps including a step in which hot pressing is performed. The hot pressed product may be used as, for example, various structural components of a vehicle.

Figure 1B:
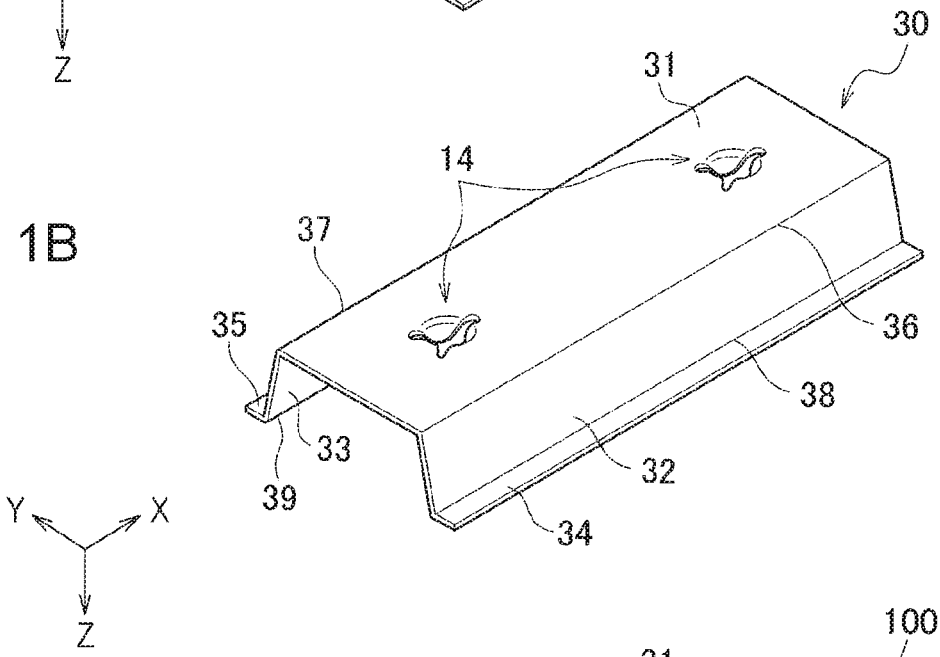
Figure 1C:
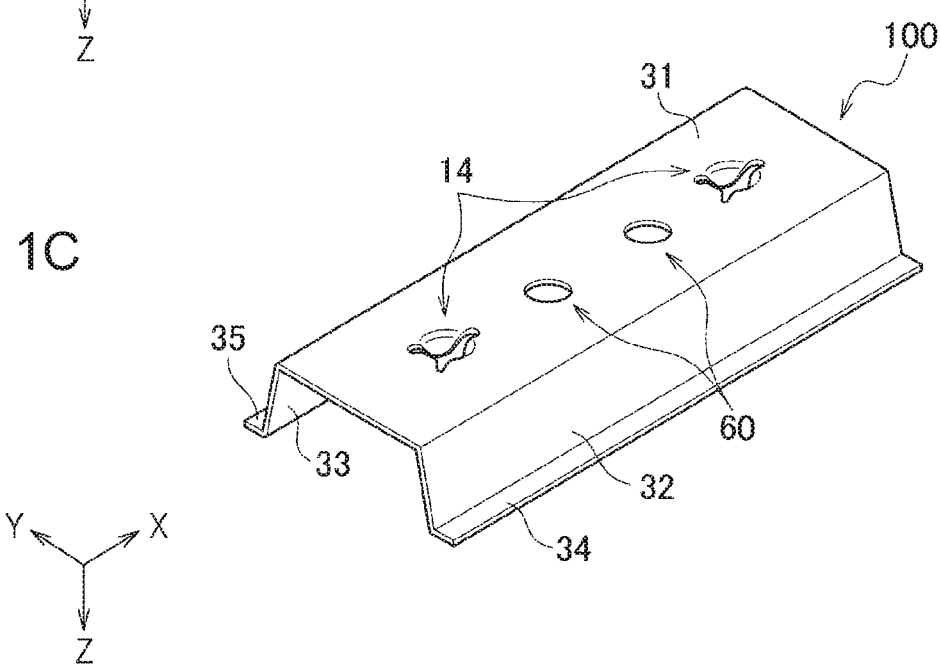

FIGS. 1A to 1C are perspective views illustrating sequential manufacturing steps for manufacturing a hot pressed product 100 according to the present embodiment. The manufacturing steps for manufacturing the hot pressed product 100 include a hole forming step, a heating step, a molding step, and a laser processing step.

Hole Forming Step

The hole forming step, which is a first step, will now be described. FIG. 1A is a perspective view of a sheet material 10 in which pilot holes 12 are formed in the hole forming step. The sheet material 10 is a raw material sheet of the hot pressed product 100. A sheet-shaped hot pressing steel material, for example, may be used as the raw material sheet. The sheet material 10 has a thickness t of, for example, 1.0 to 2.0 (mm).

In the hole forming step, the pilot holes 12, which are through holes, are formed in the sheet material 10. The pilot holes 12 serve as, for example, positioning holes in the laser processing step. The positions at which the pilot holes 12 are formed depend on the shape of the hot pressed product 100. For example, as illustrated in FIG. 1A, the pilot holes 12 may be aligned with a certain gap therebetween. There is no particular limitation regarding the type, for example, of a processing device used in the hole forming step.

Figure 2:
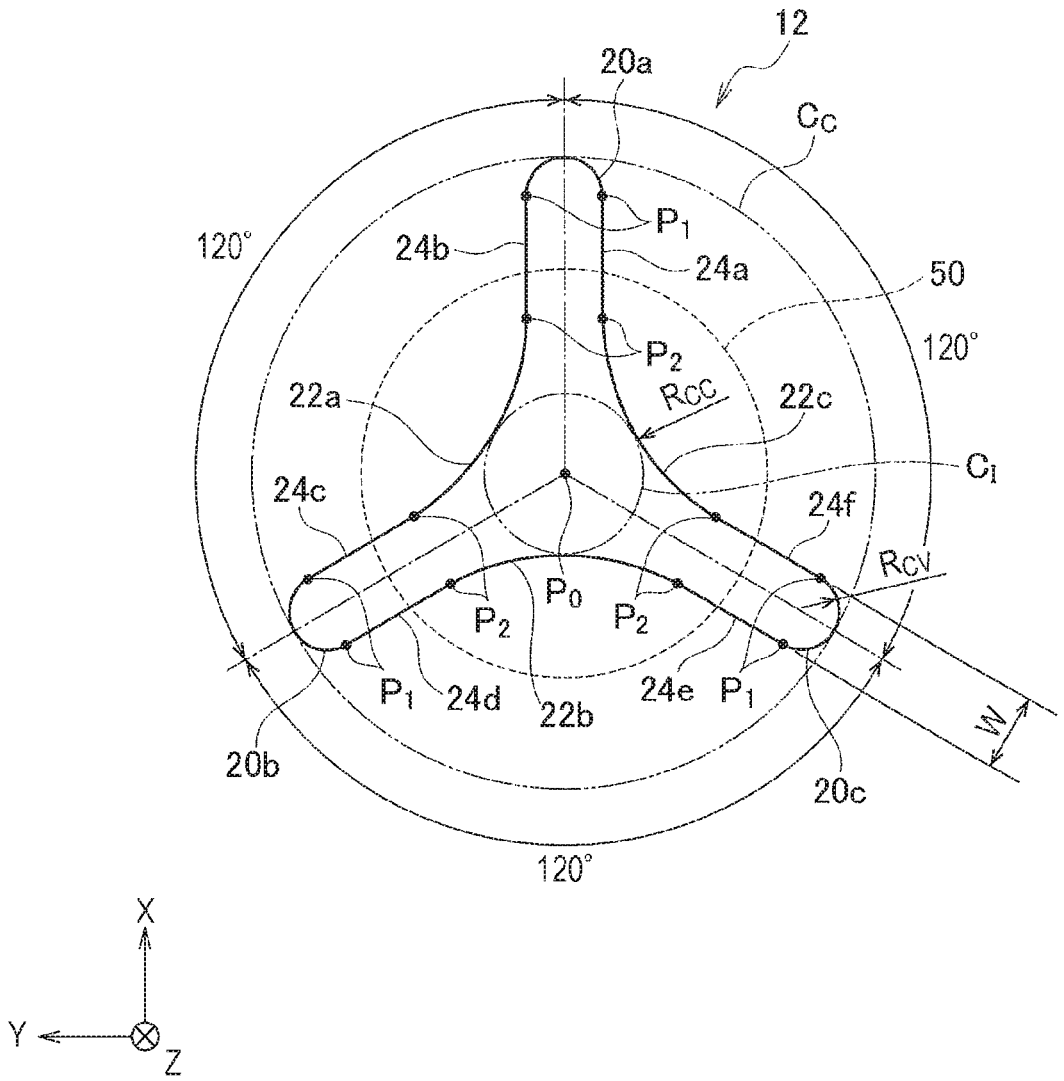
FIG. 2 illustrates a pilot hole formed in a hole forming step having an opening shape according to a first example.

FIG. 2 illustrates one of the pilot holes 12 having an opening shape according to a first example. The pilot hole 12 extends through the sheet material 10 in a direction perpendicular to the principal plane of the sheet material 10, which is the XY plane. In the following description, the opening shape of the pilot hole 12 means the shape of the opening in plan view. In addition, an opening plane means a plane that extends through the opening and that is parallel to the principal plane of the sheet material 10.

The opening shape of the pilot hole 12 is such that a plurality of convex portions 20 and a plurality of concave portions 22, preferably three or more convex portions 20 and three or more concave portions 22, are alternately arranged with straight portions 24 provided therebetween. When the centroid of the pilot hole 12 on the opening plane is defined as an opening center $P_0$, the convex portions 20 and the concave portions 22 are defined with reference to radially outward directions around the opening center $P_0$ along the opening plane. More specifically, the convex portions 20 are defined as convex portions that are outwardly convex in directions away from the opening center $P_0$. The concave portions 22 are defined as concave portions that are inwardly concave in directions toward the opening center $P_0$. Thus, the convex portions 20 are farther away from the opening center $P_0$ than the concave portions 22. An example in which three convex portions 20 and three concave portions 22 are provided, as illustrated in FIG. 2, will now be described.

The three convex portions 20*a* to 20*c* are arranged at equal intervals, that is, at intervals of 120(°) around the opening center $P_0$. Each convex portion 20 has the shape of an arc, for example, a semicircle. In the following description, it is assumed that the convex portions 20 are semicircular, and the radius of the convex portions 20 is denoted by $R_{CV}$. The three convex portions 20*a* to 20*c* are in contact with a circumscribed circle $C_C$ centered at the opening center $P_0$.

The three concave portions 22*a* to 22*c* are arranged at equal intervals, that is, at intervals of 120(°) around the opening center $P_0$ and are displaced from the convex portions 20 adjacent thereto by 60(°). Each concave portion 22 has the shape of an arc. In the following description, the radius of the concave portions 22 is denoted by $R_{CC}$. The three concave portions 22*a* to 22*c* are in contact with an inscribed circle $C_I$ centered at the opening center $P_0$.

The convex portions 20 and the concave portions 22 are connected to each other by the straight portions 24. For example, one end of the first convex portion 20*a* is connected to one end of the first straight portion 24*a*, and the other end of the first straight portion 24*a* is connected to one end of the third concave portion 22*c*. The other end of the first convex portion 20*a* is connected to one end of the second straight portion 24*b*, and the other end of the second straight portion 24*b* is connected to one end of the first concave portion 22*a*. The second convex portion 20*b* and the third convex portion 20*c* are structured similarly to the first convex portion 20*a*. In the following description, the points at which the convex portions 20 are in contact with the straight portions 24 are referred to as first contact points $P_1$, and the points at which the concave portions 22 are in contact with the straight portions 24 are referred to as second contact points $P_2$.

The convex portions 20 are connected to the straight portions 24 by tangent lines at the first contact points $P_1$. Therefore, the opening is smooth and has no steps at the first contact points $P_1$. Similarly, the concave portions 22 are connected to the straight portions 24 by tangent lines at the second contact points $P_2$. Therefore, the opening is also smooth and has no steps at the second contact points $P_2$.

Two straight portions 24 that are individually connected to the respective first contact points $P_1$ at both ends of each convex portion 20 and that face each other are roughly parallel to each other. In the following description, the distance between the two straight portions 24 that face each other is denoted by W. In the example illustrated in FIG. 2, the two straight portions 24 that face each other are parallel to each other.

The above description shows that the opening shape of the pilot hole 12 is defined by a wavy closed line that alternately comes into contact with the circumscribed circle $C_C$ and the inscribed circle $C_I$. In addition, in the present embodiment, the opening shape of the pilot hole 12 satisfies the following conditions.

The first condition is that the radius $R_{CV}$ of the convex portions 20 and the radius $R_{CC}$ of the concave portions 22 satisfy Expression (1).

$$R_{CV}<R_{CC} \tag{1}$$

When Expression (1) is satisfied, the distance W between the two straight portions 24 that face each other is short. Therefore, the area of flange portions 52 formed in a burring process performed subsequently in the molding step can be increased. The burring process will be described in detail below in the description of the molding step.

The second condition is that when $D_C$ is the diameter of the circumscribed circle $C_C$, $D_I$ is the diameter of the inscribed circle $C_I$, and $D_B$ is a punch diameter, which is the diameter of a burring punch 50 used in the burring process, $D_C$, $D_I$, and $D_B$ satisfy Expression (2).

$$D_I<D_B<D_C \quad (2)$$

When Expression (2) is satisfied, portions of the sheet material 10 including the concave portions 22 are always bent when the burring process is performed in the molding step.

The third condition is that the punch diameter $D_B$ is set so that the circumference of the burring punch 50 crosses the straight portions 24. In other words, the circumference of the burring punch 50 is located between the first contact point $P_1$ and the second contact point $P_2$ of each straight portion 24 in the burring process. When this condition is satisfied, bent portions of the flange portions 52 are not located at any of the convex portions 20*a* to 20*c* in the burring process.

Examples of dimensions will now be described. Here, it is assumed that the sheet material 10 is a sheet-shaped hot pressing steel material having a thickness t of 1.4 (mm). In addition, it is assumed that the punch diameter $D_B$ of the burring punch 50 used in the burring process is 16 (mm). In this case, the diameter $D_C$ of the circumscribed circle $C_C$ may be 24.7 (mm). The diameter $D_I$ of the inscribed circle $C_I$ may be 6.6 (mm). The radius $R_{CV}$ of the convex portions 20 may be 1.5 (mm). The radius $R_{CC}$ of the concave portions 22 may be 10 (mm). The distance W between the two straight portions 24 that face each other may be 3.0 (mm).

The opening shape of the pilot hole 12 is not limited to the shape illustrated in FIG. 2. The opening shape of the pilot hole 12 may instead be the shapes described below as long as the above-described conditions are satisfied.

In the example illustrated in FIG. 2, the opening shape of the pilot hole 12 includes the three convex portions 20 and the three concave portions 22. However, according to the present invention, the opening shape of the pilot hole 12 is not limited to this as long as a plurality of convex portions 20 and a plurality of concave portions 22, preferably three or more convex portions 20 and three or more concave portions 22, are present.

Figure 3A:
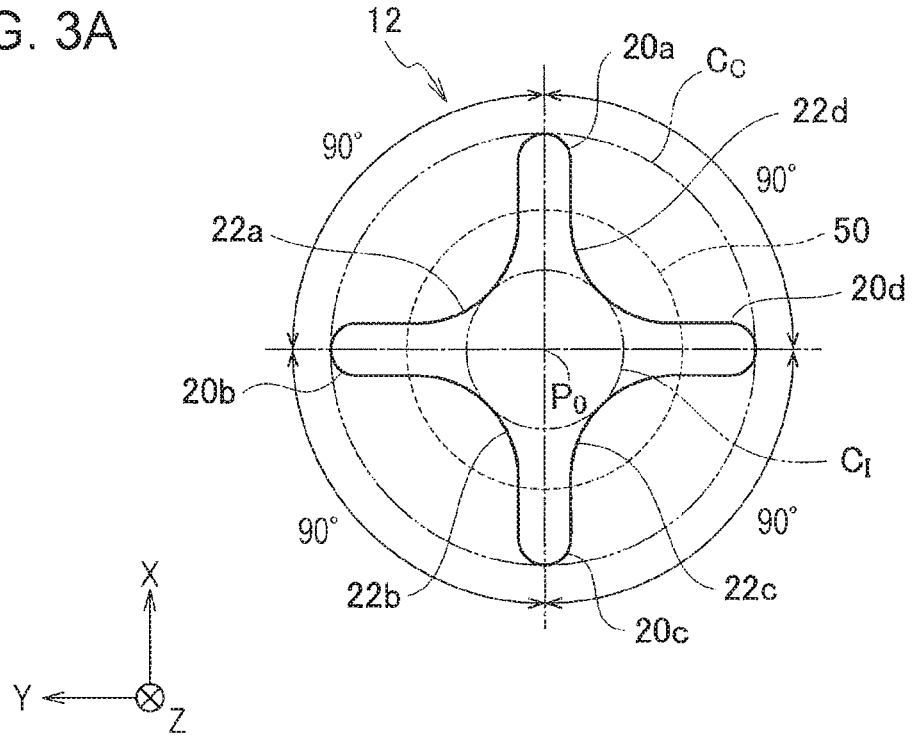
FIGS. 3A and 3B illustrate pilot holes formed in the hole forming step having opening shapes according to a second example.
Figure 3B:
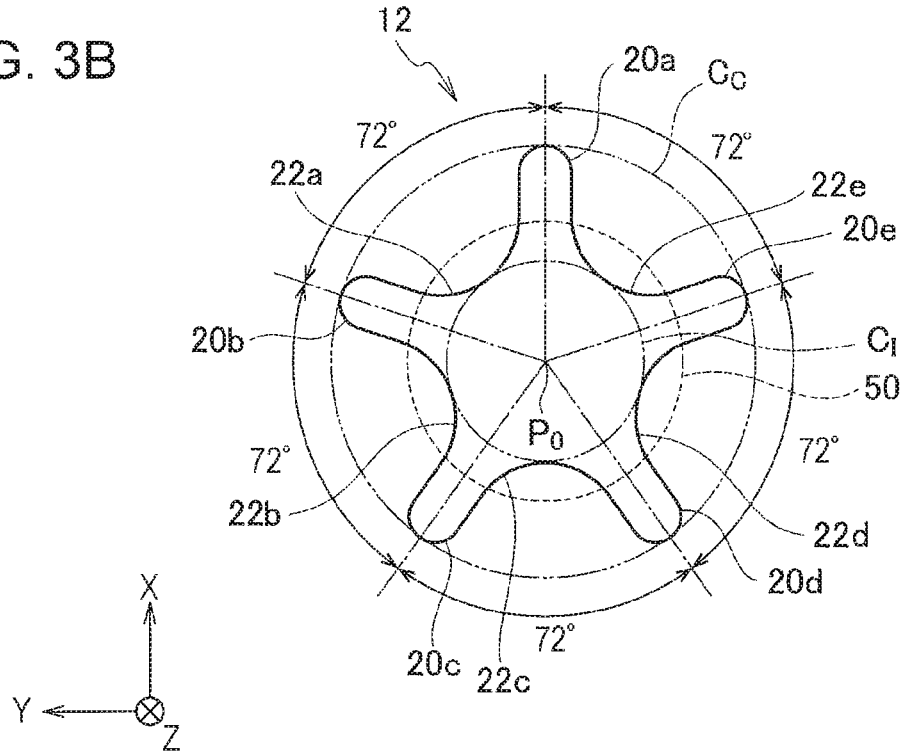

FIGS. 3A and 3B illustrate pilot holes 12 having opening shapes according to a second example. In FIGS. 3A and 3B, portions corresponding to the portions of the pilot hole 12 illustrated in FIG. 2 are denoted by the same reference numerals.

The pilot hole 12 illustrated in FIG. 3A has an opening shape including four convex portions 20 and four concave portions 22. In this case, the four convex portions 20*a* to 20*d* are arranged at intervals of 90(°) around the opening center $P_0$. The four concave portions 22*a* to 22*d* are arranged at intervals of 90(°) around the opening center $P_0$ and are displaced from the convex portions 20 adjacent thereto by 45(°).

The pilot hole 12 illustrated in FIG. 3B has an opening shape including five convex portions 20 and five concave portions 22. In this case, the five convex portions 20*a* to 20*e* are arranged at intervals of 72(°) around the opening center $P_0$. The five concave portions 22*a* to 22*e* are arranged at intervals of 72(°) around the opening center $P_0$ and are displaced from the convex portions 20 adjacent thereto by 36(°).

In the example illustrated in FIG. 2, the opening shape of the pilot hole 12 is defined based on the following first and second assumptions. The first assumption is that the centers of the circumscribed circle $C_C$, the inscribed circle $C_I$, and the burring punch 50 coincide with the opening center $P_0$. The second assumption is that the convex portions 20 and the concave portions 22 are arranged with equal intervals around the opening center $P_0$. However, according to the present invention, it is not necessary that these assumptions be satisfied.

Figure 4A:
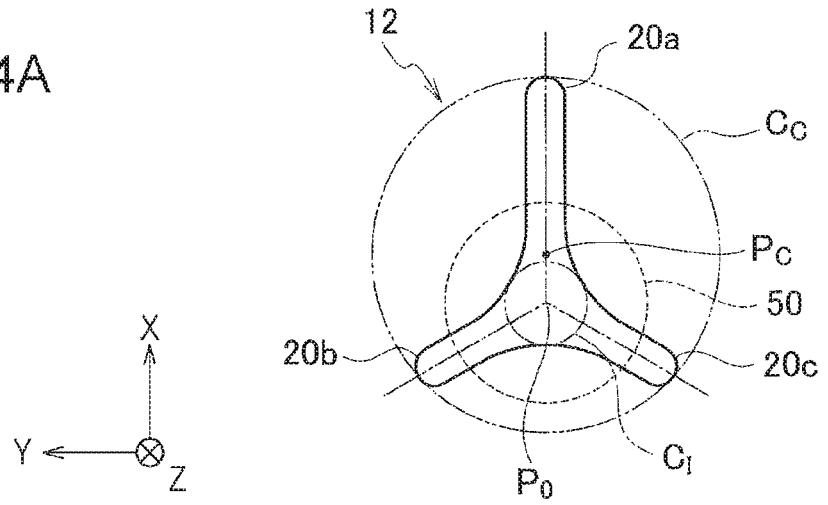
FIGS. 4A to 4C illustrate pilot holes formed in the hole forming step having opening shapes according to a third example.
Figure 4B:
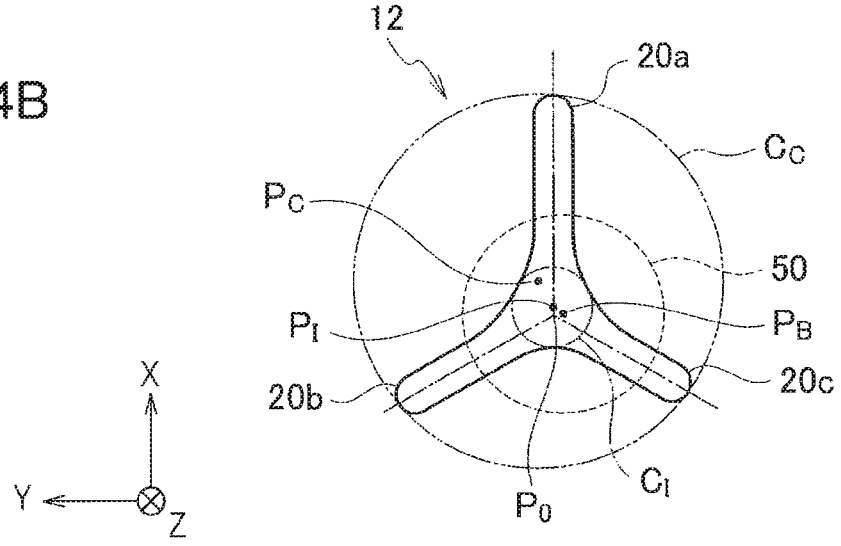
Figure 4C:
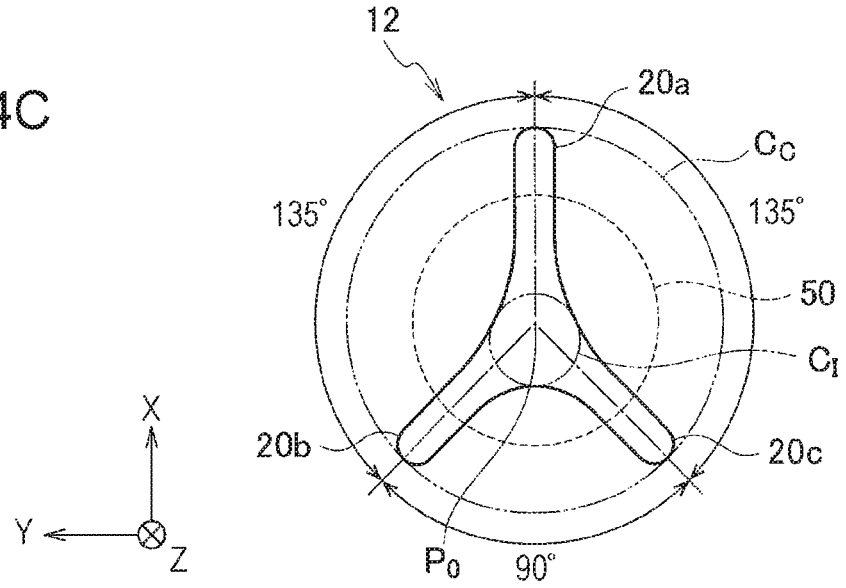

FIGS. 4A to 4C illustrate pilot holes 12 having opening shapes according to a third example. In FIGS. 4A to 4C, portions corresponding to the portions of the pilot hole 12 illustrated in FIG. 2 are denoted by the same reference numerals.

FIG. 4A relates to the first assumption, and illustrates the case in which the centers of the inscribed circle $C_I$ and the burring punch 50 coincide with the opening center $P_0$, but the center $P_C$ of the circumscribed circle $C_C$ is displaced from the opening center $P_0$. In this case, the distance from the opening center $P_0$ to the convex portion 20*a* is greater than the distance from the opening center $P_0$ to the convex portion 20*b* or the convex portion 20*c*.

FIG. 4B relates to the first assumption, and illustrates the case in which none of the center $P_C$ of the circumscribed circle $C_C$, the center $P_I$ of the inscribed circle $C_I$, and the center $P_B$ of the burring punch 50 coincides with the opening center $P_0$. In this case, the distances from the opening center $P_0$ to the convex portions 20*a* to 20*c* differ from each other.

FIG. 4C relates to the second assumption, and illustrates the case in which the intervals between the convex portions 20*a* and 20*b* and between the convex portions 20*a* and 20*c* are both 135(°) around the opening center $P_0$ but the interval between the convex portions 20*b* and 20*c* is 90(°) around the opening center $P_0$.

The shapes illustrated in FIGS. 4A to 4C have the following advantages. For example, when the molding step is performed by using a die set 40 as described below, it may be expected that the sheet material 10 is easily shifted in a certain direction depending on the shapes of the sheet material 10 and a part 30 to be molded, the positions of the pilot holes 12, and the structure of the die set 40. In such a case, each pilot hole 12 may be formed in an irregular shape as illustrated in FIGS. 4A to 4C depending on the direction in which the sheet material 10 is easily shifted so that burred portions 14 having the desired shape can be formed in the molding step.

The hole forming step may either be independently performed before the subsequent heating step, or be performed simultaneously with a step of forming the sheet material 10 by cutting a sheet-shaped or roll-shaped material.

Heating Step

Next, in the heating step, which is a second step, the sheet material 10 in which the pilot holes 12 are formed in the hole forming step is heated to, for example, 700(° C.) to 950(° C.). There is no particular limitation regarding the type, for example, of a heating device used in the heating step.

Molding Step

The molding step, which is a third step, will now be described. FIG. 1B is a perspective view illustrating the appearance of the molded part 30 obtained as a result of the molding step. In the molding step, the sheet material 10 heated in the heating step is molded into the molded part 30 by using the die set 40 described below.

The overall body of the molded part 30 includes a top plate portion 31, a first side plate portion 32, a second side plate portion 33, a first flange portion 34, and a second flange portion 35. In the following description, the direction in which the top surface of the top plate portion 31 (surface illustrated in FIG. 1B) faces in side view of the molded part 30 is defined as front, and the direction in which the bottom surface of the top plate portion 31 (surface not illustrated in FIG. 1B) faces in side view of the molded part 30 is defined as back.

The top plate portion 31 is a flat plate portion that remains parallel to the principal plane of the sheet material 10 after hot pressing. The top plate portion 31 has, for example, a rectangular shape whose longitudinal direction is the X direction in plan view.

The first side plate portion 32 is a flat plate portion that is connected to the top plate portion 31 at a first edge 36 extending in the longitudinal direction and that is bent in the Z direction along the first edge 36. The first side plate portion 32 is not perpendicular to the plane of the top plate portion 31, and a crossing angle between the top plate portion 31 and the first side plate portion 32 at the first edge 36 is obtuse.

The second side plate portion 33 is a flat plate portion that is connected to the top plate portion 31 at a second edge 37 extending in the longitudinal direction and that is bent in the Z direction along the second edge 37. The second side plate portion 33 is not perpendicular to the plane of the top plate portion 31, and a crossing angle between the top plate portion 31 and the second side plate portion 33 at the second edge 37 is obtuse. In the example illustrated in FIG. 1B, the first edge 36 and the second edge 37 are parallel to each other.

The first flange portion 34 is a flat plate portion that is connected to the first side plate portion 32 at a third edge 38 extending in the longitudinal direction and that is bent along the third edge 38 so as to extend parallel to the plane of the top plate portion 31. In the example illustrated in FIG. 1B, the first edge 36 and the third edge 38 are parallel to each other.

The second flange portion 35 is a flat plate portion that is connected to the second side plate portion 33 at a fourth edge 39 extending in the longitudinal direction and that is bent along the fourth edge 39 so as to extend parallel to the plane of the top plate portion 31. In the example illustrated in FIG. 1B, the second edge 37 and the fourth edge 39 are parallel to each other.

The distance between the first edge 36 and the second edge 37, which corresponds to the width of the top plate portion 31, is less than the distance between the third edge 38 and the fourth edge 39. Therefore, the molded part 30 is hat-shaped when viewed in the longitudinal direction.

The molded part 30 includes the burred portions 14 formed by deforming the pilot holes 12, which are formed in the hole forming step, in the molding step.

Figure 5A:
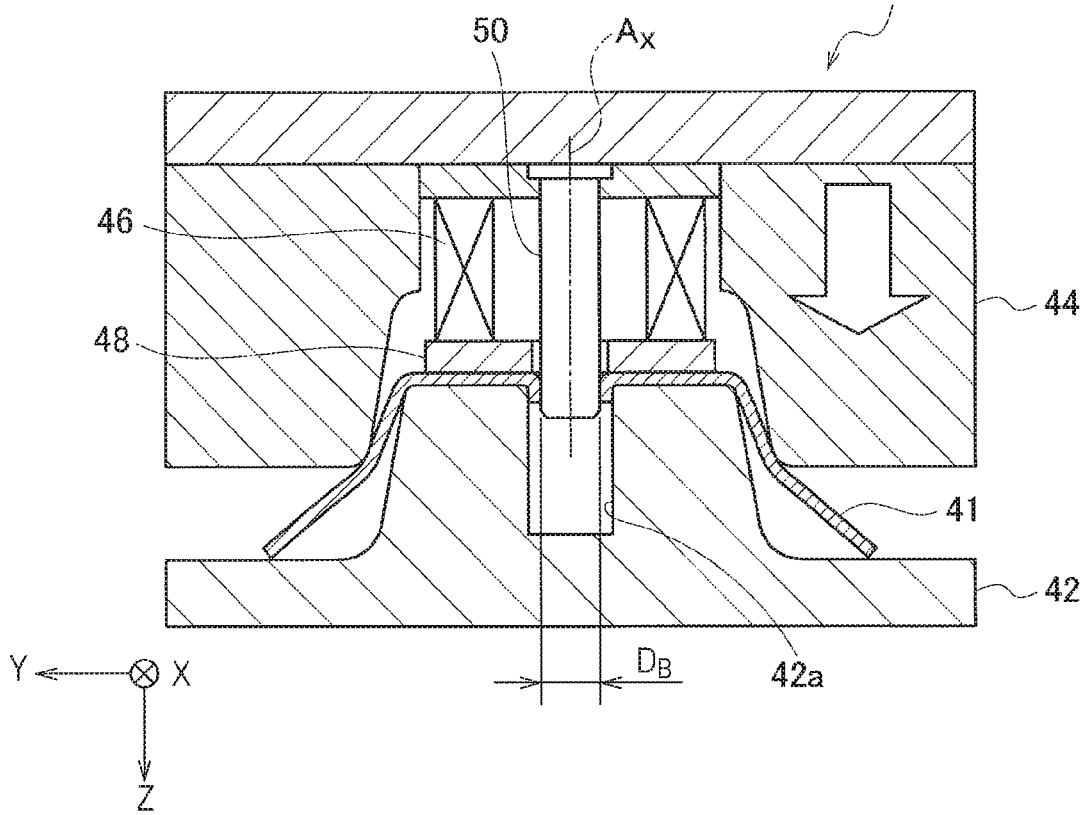
FIGS. 5A and 5B illustrate the structure of a die set used in a molding step.
Figure 5B:
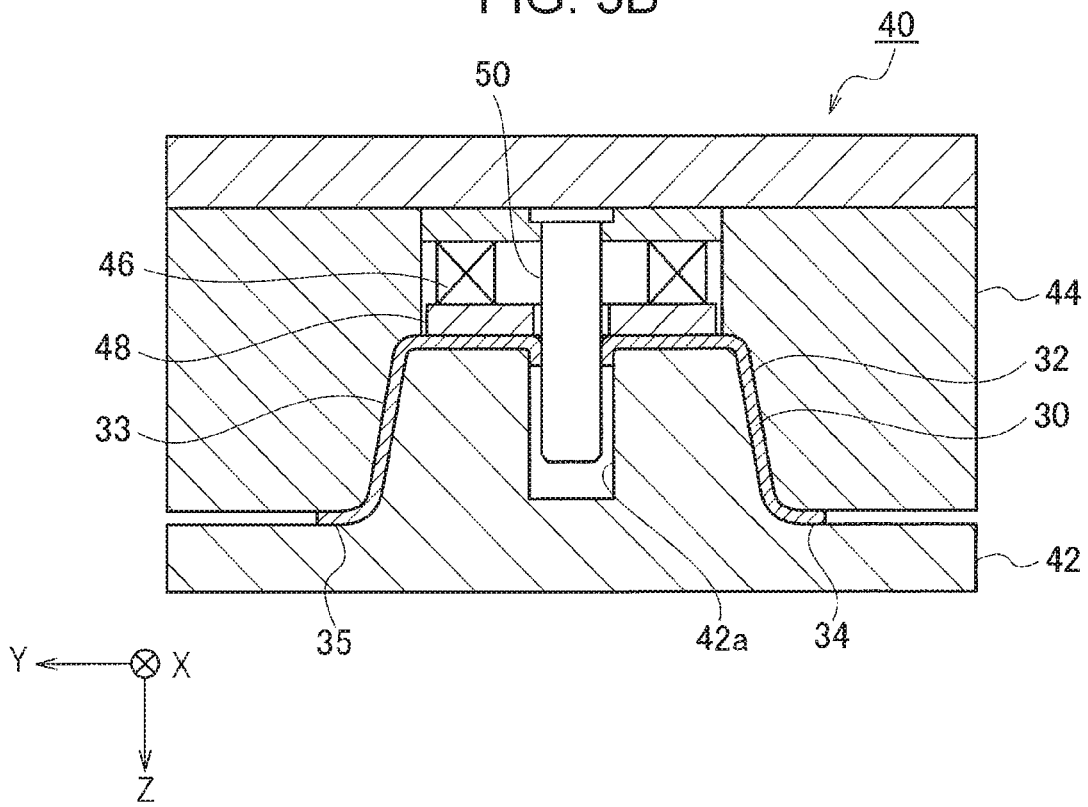

FIGS. 5A and 5B are sectional views illustrating the structure and states of the die set used in the molding step. FIG. 5A illustrates the structure of the die set 40, which is used to mold the sheet material 10 heated in the heating step into the shape of the molded part 30, during the molding process (half-molded part 41). FIG. 5B illustrates the state in which the sheet material 10 has been molded into the molded part 30. In other words, FIG. 5B illustrates the state in which the operation of a pressing machine (not shown) is stopped at the bottom dead center.

The die set 40 includes a die 42 and a punch 44 that sandwich and press the sheet material 10 therebetween. The die 42 is a lower piece that comes into contact with the back surface of the sheet material 10 and has a shape corresponding to the shape of the back surface of the molded part 30. The die 42 has a receiving space 42*a* that receives the burring punch 50 fixed to the punch 44 when the die 42 and the punch 44 are brought together. The punch 44 is an upper piece that comes into contact with the front surface of the sheet material 10 and has a shape corresponding to the shape of the front surface of the molded part 30.

The die set 40 also includes a pressing pad 48 that is suspended from the punch 44 by a spring 46 and the burring punch 50. The pressing pad 48 presses the front surface of the sheet material 10 placed on the die 42 to stabilize the position of the sheet material 10. Since the pressing pad 48 is suspended by the spring 46, the pressing pad 48 continuously presses the sheet material 10 to prevent the sheet material 10 from being displaced while the punch 44 is being moved toward the die 42.

The die set 40 illustrated in FIG. 5A is operated so that the burring punch 50 performs the burring process on the corresponding pilot hole 12 to form the burred portion 14 when the sheet material 10 is sandwiched between the die 42 and the punch 44. The burring punch 50, which is a rod having a circular cross section, has one end fixed to the punch 44, and the other end thereof comes into contact with the pilot hole 12. In the burring process, the burring punch 50 is moved along a movement axis $A_X$ that is parallel to the Z direction. The punch diameter $D_B$ of the burring punch 50 satisfy the above-described conditions. The sheet material 10 is bent into the half-molded part 41 illustrated in FIG. 5A by the die 42 and the punch 44.

The die set 40 illustrated in FIG. 5B is in such a state that upper pieces thereof including the punch 44, the burring punch 50, the pressing pad 48, and the spring 46 are at the bottom dead center of the pressing machine. Accordingly, the sheet material 10 that has been bent into the half-molded part 41 is molded into the molded part 30 in accordance with the shapes of the punch 44 and the die 42. Thus, the first side plate portion 32, the second side plate portion 33, the first flange portion 34, and the second flange portion 35, which have not been completed in the half-molded part 41 illustrated in FIG. 5A, are completed in the state illustrated in FIG. 5B.

The burred portion 14 is completed when the burring punch 50 is inserted deep into the receiving space 42*a*. The pressing pad 48 is continuously pressed against the top plate portion 31 by the spring 46. When the sheet material 10 is retained in this state for several seconds, the sheet material 10 is rapidly cooled from the temperature to which the sheet material 10 was heated in the heating step. Thus, the molded part 30 that has been subjected to quenching is obtained.

Figure 6A:
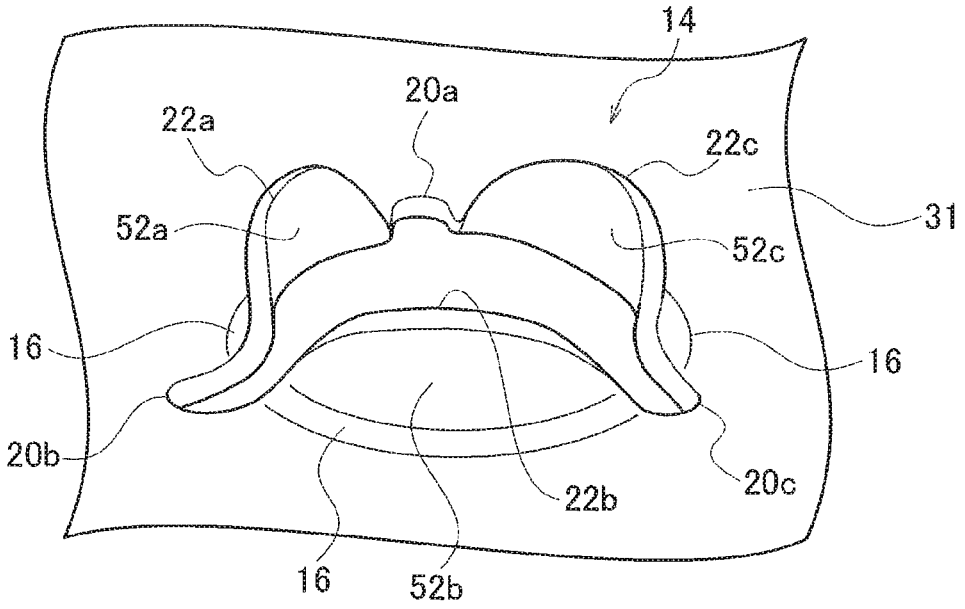
FIGS. 6A and 6B are back views of examples of a burred portion formed in the molding step.
Figure 6B:
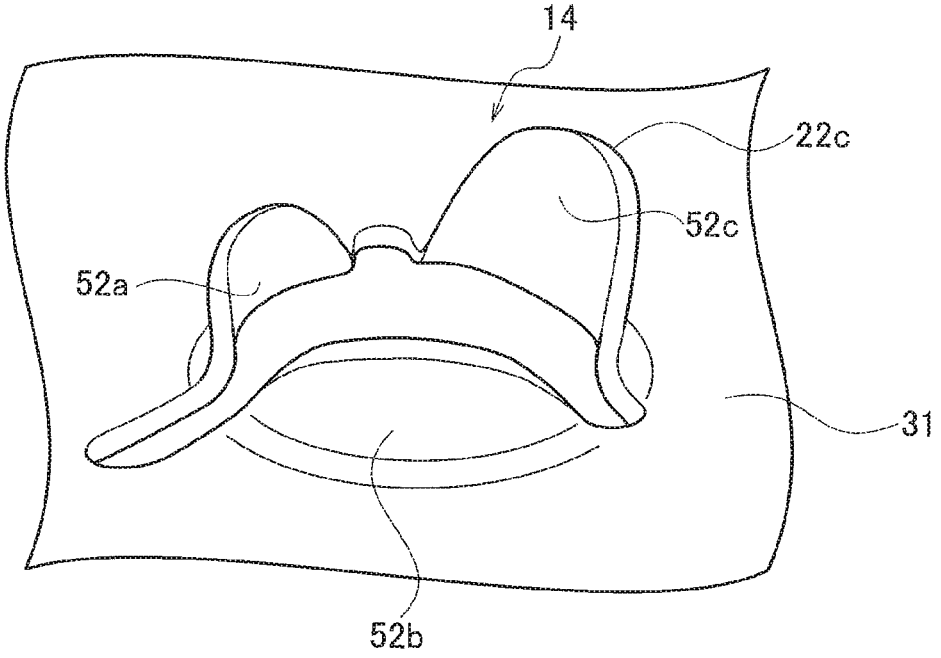

FIGS. 6A and 6B are perspective views of examples of the burred portion 14 viewed from the back.

The burred portion 14 illustrated in FIG. 6A is formed when the burring process is performed with substantially no displacement between the pilot hole 12 and the burring punch 50. The punch diameter $D_B$ is greater than the diameter $D_I$ of the inscribed circle $C_I$ and is less than the diameter $D_C$ of the circumscribed circle $C_C$. In addition, the punch diameter $D_B$ is set so that the circumference of the burring punch 50 crosses each of the straight portions 24*a* to 24*f*. Therefore, when the burring punch 50 is inserted through the pilot hole 12, three projecting flange portions 52*a* to 52*c* including the concave portions 22 of the pilot hole 12 are bent along the outer peripheral surface of the burring punch 50 so as to form edge portions 16 that match the punch diameter $D_B$. As is clear from the shape of the thus-formed burred portion 14, only the three flange portions 52*a* to 52*c* are deformed in the burring process. In other words, the three convex portions 20*a* to 20*c* of the pilot hole 12 are not deformed and remain unchanged. In addition, no cracks are formed in the three flange portions 52*a* to 52*c*.

The burred portion 14 illustrated in FIG. 6B is formed when the burring process is performed while the burring punch 50 is displaced with respect to the pilot hole 12. When the burring process is performed while the burring punch 50 is displaced, for example, in a direction from the opening center $P_0$ of the pilot hole 12 toward the concave portion 22*c*, the three flange portions 52*a* to 52*c* are formed such that the flange portion 52*c* is higher than the other flange portions 52*a* and 52*b*. The convex portions 20*a* to 20*c* are not deformed and remain unchanged. Also in this case, no cracks are formed in any of the flange portions 52*a* to 52*c*.

Laser Processing Step

The laser processing step, which is a fourth step, will now be described. FIG. 1C is a perspective view illustrating the appearance of the hot pressed product 100 obtained as a result of the laser processing step. In the laser processing step, the molded part 30 is formed into the shape of the hot pressed product 100 by removing unnecessary portions from the molded part 30 by a laser process using the burred portions 14 formed in the molding step as a positioning reference. In the example illustrated in FIG. 1C, two holes 60 having a circular opening shape are formed by removing unnecessary portions. There is no particular limitation regarding the type, for example, of a laser processing apparatus used in the laser processing step.

Although not illustrated, the laser processing apparatus includes locator pins having a diameter substantially equal to the punch diameter $D_B$ of the burring punch 50 used in the burring process in the molding step. The molded part 30 is mounted in the laser processing apparatus at a predetermined position for processing, and then the locator pins are inserted through the burred portions 14. The locator pins have substantially the same diameter as that of the burring punch 50, and therefore can be inserted through the burred portions 14, each of which is formed by the burring punch 50, without clearances. The laser processing apparatus determines the positions of the unnecessary portions of the molded part 30 by using the positions of the locator pins as references, and removes the unnecessary portions. Thus, the burred portions 14 serve as positioning holes used as positioning references by the laser processing apparatus.

Figure 7:
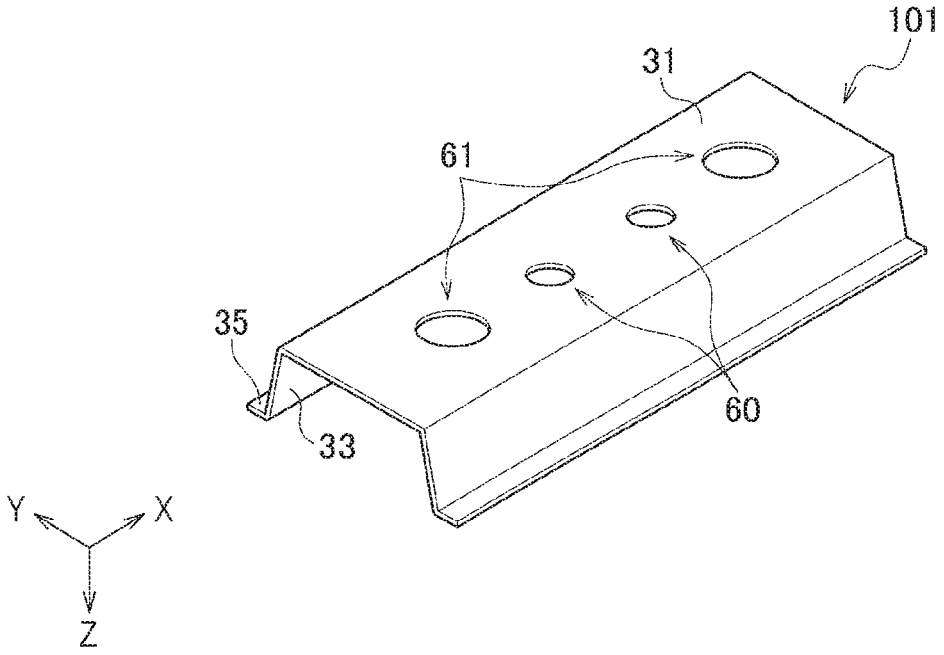
FIG. 7 illustrates another example of a hot pressed product manufactured by the method according to the present invention.

In the laser processing step, a hot pressed product 101 illustrated in FIG. 7 may instead be formed by cutting out the burred portions 14 of the top plate portion 31 to form holes 61 by a laser process.

The effects of the present embodiment will now be described.

According to the present embodiment, the method for manufacturing the hot pressed product 100 by heating the sheet material 10 and quenching the sheet material 10 while molding the sheet material 10 includes a hole forming step of forming the pilot holes 12 in the sheet material 10 and a heating step of heating the sheet material 10 in which the pilot holes 12 are formed in the hole forming step. The manufacturing method also includes a molding step of forming the burred portion 14 at each pilot hole 12 by using the burring punch 50 included in the die set 40 while molding the sheet material 10 heated in the heating step in the die set 40. Each pilot hole 12 has the opening shape in which the convex portions 20*a* to 20*c* and the concave portions 22*a* to 22*c* are alternately arranged. The diameter $D_C$ of the circumscribed circle $C_C$ that is in contact with the convex portions 20*a* to 20*c* is greater than the diameter $D_B$ of the burring punch 50. The diameter $D_I$ of the inscribed circle $C_I$ that is in contact with the concave portions 22*a* to 22*c* is less than the diameter $D_B$ of the burring punch 50.

According to the manufacturing method of the present embodiment, the opening shape of each pilot hole 12 is specified as described above, and the diameter $D_I$ of the inscribed circle $C_I$ is less than the punch diameter $D_B$. As a result, a flange portion having an overall cylindrical shape is not formed in the burring process in the molding step, but three projecting flange portions 52*a* to 52*c* including the concave portions 22 of the pilot hole 12 are formed, as illustrated in FIGS. 6A and 6B. Therefore, even when the pressing position of the burring punch 50 with respect to the pilot hole 12 is displaced from the set position, that is, even when misalignment occurs in the molding step, all of the flange portions 52*a* to 52*c* can be smoothly bent. Accordingly, the burred portion 14 can be used as a positioning hole that serves as an assembly reference when the resulting hot pressed product 100 is installed as a vehicle component during assembly. Thus, a high quality hot pressed product 100 that does not affect the positional accuracy, for example, during assembly can be obtained.

Since the diameter $D_C$ of the circumscribed circle $C_C$ is greater than the punch diameter $D_B$, the three convex portions 20*a* to 20*c* of the pilot hole 12 and parts of the straight portions 24 connected to the convex portions 20 remain on the top plate portion 31 of the sheet material 10 unchanged after the burred portion 14 is formed in the molding step. Therefore, even when the pressing position of the burring punch 50 with respect to the pilot hole 12 is displaced from the set position in the molding step and one of the flange portions 52 receives a greater force than the other flange portions 52, the force can be partially dispersed toward the convex portions 20. Thus, the flange portions 52 are shaped such that the flange portions 52 do not easily receive an unexpectedly large force, and the occurrence of cracks in the flange portions 52 can be reduced. In other words, a high quality hot pressed product 100 in which no cracks are formed in the flange portions 52 of the burred portion 14 can be obtained.

Figure 9A:
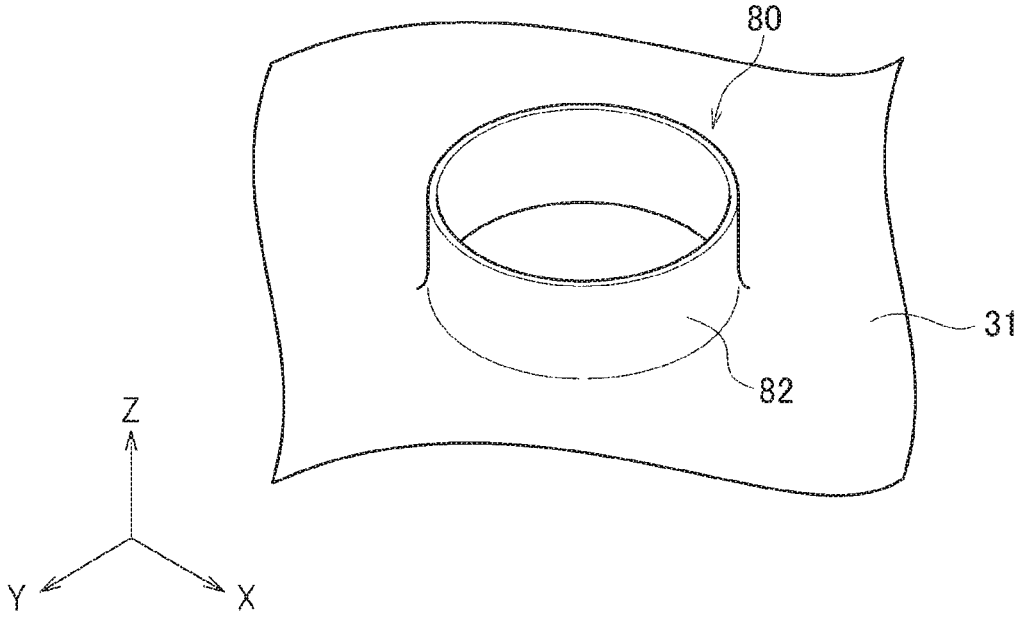
FIGS. 9A and 9B illustrate cracks formed in a burred portion according to the related art.
Figure 9B:
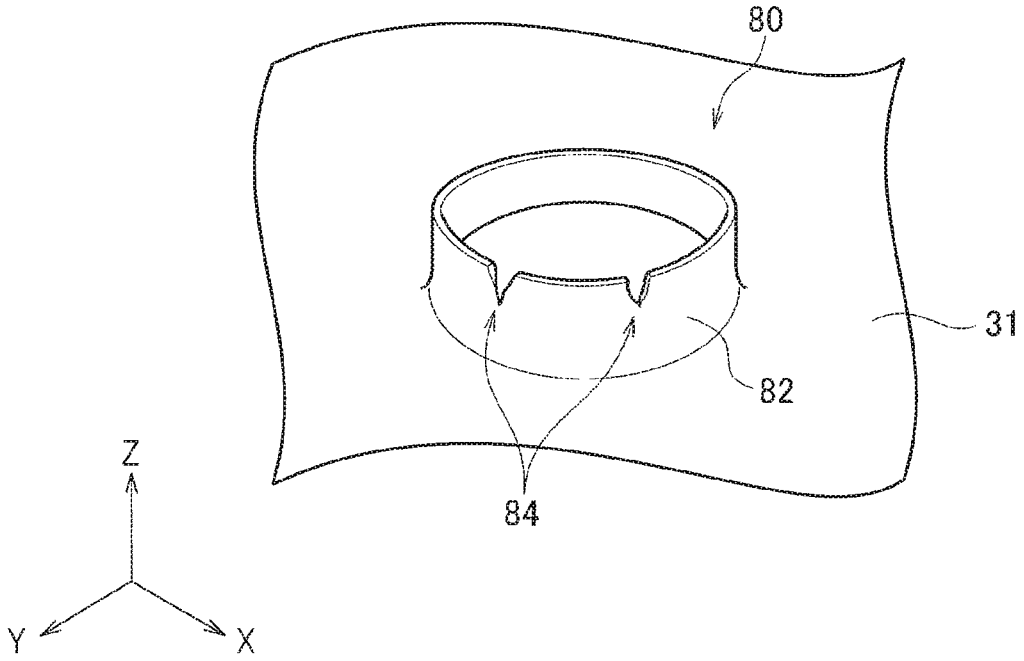

A burred portion 80 formed by a method for manufacturing a hot pressed product according to the related art will now be described as a comparative example. FIGS. 9A and 9B are back perspective views of examples of the burred portion 80. Assume that a pilot hole according to the related art is formed in the top plate portion 31 according to the present embodiment instead of the pilot hole 12 according to the present embodiment. The pilot hole according to the related art has a circular opening shape. The burred portion 80 is formed by using a burring punch having a punch diameter greater than the diameter of the circular pilot hole.

FIG. 9A illustrates the case in which the burred portion 80 has a normal shape. The burred portion 80 includes a cylindrical flange portion 82. When, for example, the pressing position of the burring punch with respect to the pilot hole is not displaced from the set position by a large distance, the peripheral region around the pilot hole receives a uniform force from the burring punch, so that cracks are not easily formed in the flange portion 82.

FIG. 9B illustrates the case in which the burred portion 80 is shaped such that cracks 84 are formed in the flange portion 82. Unlike the case illustrated in FIG. 9A, when the pressing position of the burring punch with respect to the pilot hole is displaced from the set position by a large distance, a portion of the peripheral region around the pilot hole receives a large local force from the burring punch. In particular, when the pilot hole has a simple circular opening shape, the entire peripheral region around the pilot hole are bent. Therefore, when a large local force is applied, the applied force cannot be dispersed. As a result, the cracks 84 are formed to release the force. In the case where the cracks 84 are present in a hot pressed product installed in, for example, a vehicle structure, there is a risk that a fracture will occur due to the cracks 84 when an impact occurs for any reason.

The manufacturing method according to the present embodiment further includes a laser processing step of performing a laser process on the molded part 30 by using the burred portion 14 formed in the molding step as a reference.

In the manufacturing method according to the present embodiment, when the molded part 30 needs to be subjected to a laser process in a post-processing step, the burred portion 14 may be used as a positioning hole that serves as a positioning reference by a laser processing apparatus. Accordingly, a high-quality hot pressed product 100 can be obtained because the laser process is performed by the laser processing apparatus with a high positional accuracy.

In the manufacturing method according to the present embodiment, each concave portion 22 has the shape of an arc, and is connected to corresponding ones of the convex portions 20 by the straight portions 24, which are tangent lines of the arc.

According to the manufacturing method of the present embodiment, since each concave portion 22 of the pilot hole 12 has the shape of an arc and the straight portions 24 connected thereto are tangent lines, the pilot hole 12 has a smooth shape with no steps or corners at the second contact points $P_2$ of the concave portions 22. Therefore, the material easily expands during the burring process in the molding step, and the occurrence of cracks in the flange portions 52 including the concave portions 22 can be further reduced.

In the manufacturing method according to the present embodiment, the circumference of the burring punch 50 crosses the straight portions 24.

According to the manufacturing method of the present embodiment, the edge portions 16, which correspond to bent portions of the flange portions 52 of the burred portion 14, cross the straight portions 24. Therefore, even when the pressing position of the burring punch 50 with respect to the pilot hole 12 is displaced from the set position, the edge portions 16 are not located at the convex portions 20 of the pilot hole 12. Therefore, the occurrence of cracks in the flange portions 52 can be further reduced.

In the manufacturing method according to the present embodiment, the circumference of the burring punch 50 does not cross any of the convex portions 20.

The above-described effects will now be described in more detail. If the pressing position of the burring punch 50 is displaced from the set position and the burring process is performed at a position where the edge portions 16 cross the convex portions 20, the convex portions 20 serve as bent portions of the flange portions 52 and there is a risk that cracks will be formed in these portions. Accordingly, when the circumference of the burring punch 50 faces the pilot hole 12 at a position other than the convex portions 20, that is, at positions inside the outer ends of the straight portions 24 (first contact points $P_1$), the occurrence of cracks can be reduced.

In the manufacturing method according to the present embodiment, each convex portion 20 has the shape of an arc, and the radius $R_{CV}$ of the arc of each convex portion 20 is less than the radius $R_{CC}$ of the arc of each concave portion 22.

In the manufacturing method according to the present embodiment, for example, the straight portions 24*a* and 24*b* connected to one and the other ends of one convex portion 20 are parallel to each other.

According to the manufacturing method of the present embodiment, the convex portions 20 are semicircular and the diameter thereof is less than that of the concave portions 22. In addition, the straight portions 24 that face each other are parallel to each other. In such a case, the distance W between the straight portions 24 that face each other is small. Therefore, the area of the flange portions 52 of the burred portion 14 is sufficiently large, and high positioning accuracy can be effectively ensured by using the burred portion 14.

In the manufacturing method according to the present embodiment, the surface of the sheet material 10 in which the pilot holes 12 are formed in the molding step may be inclined with respect to the movement axis $A_X$ of the burring punch 50.

According to the above description, the sheet material 10 is placed in the die set 40 so that the top plate portion 31 of the molded part 30 is horizontal, and the movement axis $A_X$ of the burring punch 50 is perpendicular to the pilot hole 12 (see FIGS. 5A and 5B). When, for example, the surface to be subjected to the burring process is not perpendicular to the movement axis $A_X$, a bearing surface that is perpendicular to the movement axis $A_X$ is formed in advance only in a region to be processed, and the burring process is performed on the bearing surface. According to the manufacturing method of the present embodiment, the burred portion 14 can be formed even when the moving direction of the burring punch 50, which is the same as the pressing direction of the die set 40, is not perpendicular to the burred surface of the molded part 30.

Figure 8:
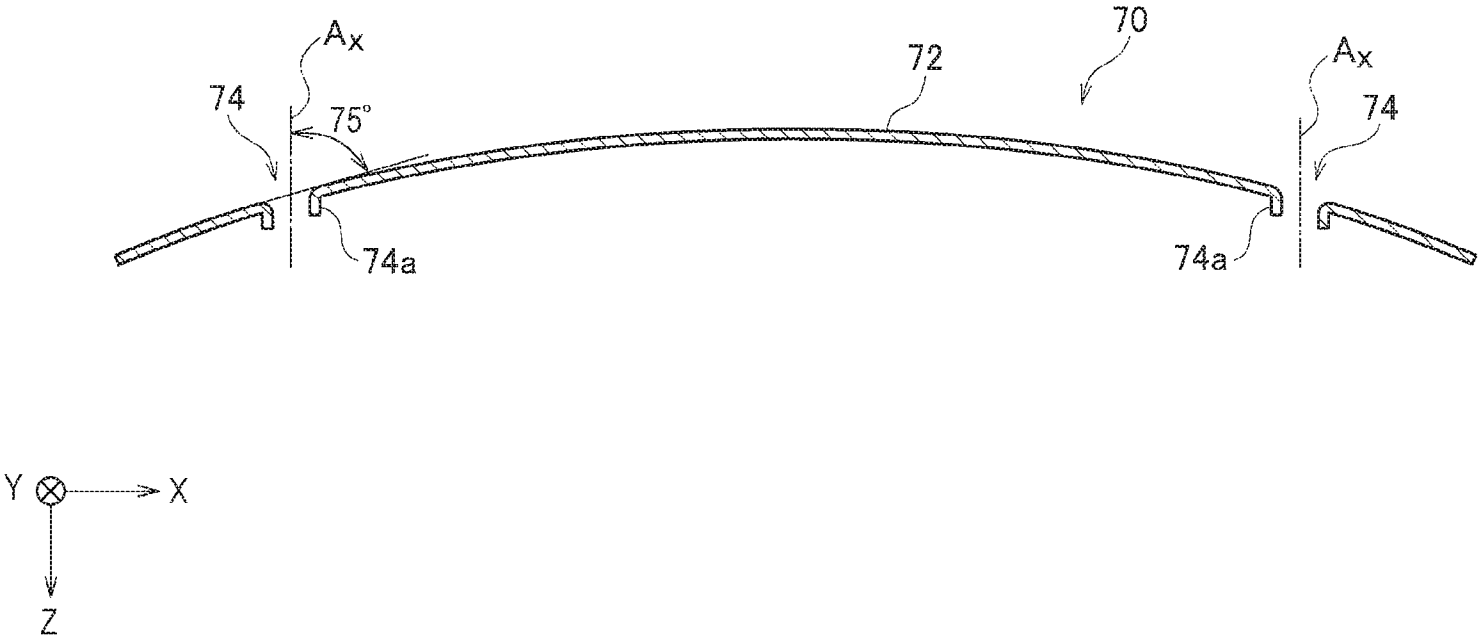
FIG. 8 illustrates burred portions formed on a curved top plate.

FIG. 8 is a sectional view of a molded part 70 including a top plate portion 72 that is curved in cross section and in which burred portions 74 are formed. Pilot holes having the above-described shape are formed in the sheet material before the molding process.

For example, assume that each pilot hole is formed in the top plate portion 72 at a position where the top plate portion 72 is inclined at 75(°) with respect to the vertical axis. In this case, the burring punch 50 forms three flange portions including a flange portion 74*a* by individually bending the three concave portions 22 at an angle with respect to the surface in which the burred portion is formed (along the movement axis $A_X$). The concave portions 22 are not simultaneously bent, but are bent at slightly different times.

In contrast, assuming that the cylindrical flange portion 82 according to the related art illustrated in FIG. 9A is formed, the end of the burring punch 50 comes into contact with different portions around the pilot hole at different times because the burring punch 50 is at an angle relative to the pilot hole. Accordingly, there is a risk that the material will fracture in the region where the burring punch 50 comes into contact first and that the burred portion 80 cannot be formed. However, according to the present embodiment, the burred portion 74 can be formed at each pilot hole 12.

Thus, according to the present embodiment, even when the moving direction of the burring punch 50 is not perpendicular to the surface on which the burred portion is to be formed, it is not necessary to form a bearing surface or the like that is perpendicular to the moving direction on the part to be molded in advance. Therefore, the design versatility can be increased.

Although the flange portions 52 of the burred portion 14 are formed so as to extend vertically downward in the above description, the flange portions 52 may instead be formed so as to extend vertically upward.

Although an embodiment of the present invention is described above, the present invention is not limited to the above-described embodiment, and various modifications and alterations are possible within the scope of the present invention.

What is claimed is:

1. A method for manufacturing a sheet material product with a burred hole, the method comprising:

forming a pilot hole in a sheet material, wherein the pilot hole has an opening shape in which a plurality of convex portions and a plurality of concave portions are alternately arranged;

heating the sheet material in which the pilot hole is formed; and molding the heated sheet material to form a molded part while forming a burred portion at the pilot hole by using a burring punch included in a die set, wherein:

a diameter of a circumscribed circle that is in contact with the convex portions of the pilot hole is greater than a punch diameter of the burring punch, and a diameter of an inscribed circle that is in contact with the concave portions of the pilot hole is less than the punch diameter of the burring punch.

2. The method of claim 1, wherein, when forming the burred portion, a surface of the sheet material in which the pilot hole is formed is inclined with respect to a movement axis of the burring punch.

3. The method of claim 1, wherein each of the concave portions of the pilot hole has a shape of a first arc, and is connected to a corresponding one of the convex portions by one of a plurality of straight portions that are a tangent line of the first arc.

4. The method of claim 3, wherein the burring punch has a circumference that crosses the straight portions.

5. The method of claim 3, wherein the burring punch has a circumference that faces the pilot hole in a region inside the concave portions of the pilot hole.

6. The method of claim 3, wherein each of the convex portions has a shape of a second arc, and wherein the second arc of each of the convex portions has a radius less than a radius of the first arc of each of the concave portions.

7. The method of claim 3, wherein each of the convex portions is connected to two of the straight portions at a first and second end of each of the convex portions, the two of the straight portions being parallel to each other.

8. A method for manufacturing a sheet metal product with a burred hole, the method comprising:

forming a pilot hole in a sheet material, wherein the pilot hole has an opening shape in which a plurality of convex portions and a plurality of concave portions are alternately arranged;

heating the sheet material in which the pilot hole is formed; and molding the heated sheet material to form a molded part while forming a burred portion at the pilot hole by using a burring punch included in a die set, wherein:

a diameter of a circumscribed circle that is in contact with the convex portions is greater than a punch diameter of the burring punch, and a diameter of an inscribed circle that is in contact with the concave portions is less than the punch diameter of the burring punch; and performing a laser process on the molded part by using the burred portion as a reference.

9. The method of claim 8, wherein, when molding the burred portion, a surface of the sheet material in which the pilot hole is formed is inclined with respect to a movement axis of the burring punch.

10. The method of claim 8, wherein each of the concave portions has a shape of a first arc, and is connected to corresponding ones of the convex portions by straight portions that are tangent lines of the first arc.

11. The method of claim 10, wherein the burring punch has a circumference that crosses the straight portions.

12. The method of claim 10, wherein the burring punch has a circumference that faces the pilot hole in a region inside the concave portions of the pilot hole.

13. The method of claim 10, wherein each of the convex portions has a shape of a second arc, and wherein the second arc has a radius less than a radius of the first arc.

14. The method of claim 10, wherein each of the convex portions is connected to two of the straight portions at one and other ends thereof, the two of the straight portions being parallel to each other.

* * * * *